US007901375B2

(12) United States Patent
Dunn et al.

(10) Patent No.: US 7,901,375 B2
(45) Date of Patent: Mar. 8, 2011

(54) MESH-TYPE FEEDER

(75) Inventors: Steven B. Dunn, Beverly Hills, CA (US); Mark Hatherill, Manhattan Beach, CA (US); Kevin D. Johnson, Los Angeles, CA (US); Charles P. Davis, Torrance, CA (US)

(73) Assignee: Munchkin, Inc., North Hills, CA (US)

( * ) Notice: Subject to any disclaimer, the term of this patent is extended or adjusted under 35 U.S.C. 154(b) by 1543 days.

(21) Appl. No.: 10/835,929

(22) Filed: Apr. 30, 2004

(65) Prior Publication Data

US 2005/0245861 A1 Nov. 3, 2005

(51) Int. Cl.
*A61J 7/00* (2006.01)
*A61J 17/00* (2006.01)

(52) U.S. Cl. ..... 604/77; 606/234; 606/235

(58) Field of Classification Search ..... 604/77, 604/79, 514, 516, 310; 606/234–236; 215/11.1, 215/70, 259, 27, 21, 11.5, 224, 236; 220/574, 220/578, 495.03, 203.04
See application file for complete search history.

(56) References Cited

U.S. PATENT DOCUMENTS

| | | | | | |
|---|---|---|---|---|---|
| 1,095,264 | A | | 5/1914 | Bridges | |
| 2,612,165 | A | * | 9/1952 | Szuderski | 606/236 |
| 2,665,693 | A | | 1/1954 | Pecora | |
| 2,824,561 | A | * | 2/1958 | Mueller | 215/11.1 |
| 3,022,915 | A | | 2/1962 | Mullin | |
| 3,076,574 | A | | 2/1963 | Woodbury, Jr. | |
| 3,267,937 | A | * | 8/1966 | Verschoor | 606/236 |
| 3,610,248 | A | | 10/1971 | Davidson | |
| 3,669,117 | A | * | 6/1972 | Herbst | 606/235 |
| 3,742,950 | A | | 7/1973 | Endrody | |
| 4,005,800 | A | * | 2/1977 | Schurman | 220/831 |
| 4,192,307 | A | * | 3/1980 | Baer | 606/236 |
| 4,488,551 | A | | 12/1984 | Connelly | |
| 4,915,242 | A | | 4/1990 | Marte | |
| 5,078,734 | A | | 1/1992 | Nobel | |
| 5,085,634 | A | | 2/1992 | Lackney | |
| 5,123,915 | A | | 6/1992 | Miller et al. | |
| 5,176,705 | A | | 1/1993 | Nobel | |
| 5,180,071 | A | * | 1/1993 | Crosson | 215/11.1 |
| 5,364,348 | A | * | 11/1994 | Berry, Sr. | 604/77 |
| 5,395,392 | A | * | 3/1995 | Suhonen | 606/234 |
| 6,080,027 | A | | 6/2000 | Rodemann | |
| 6,447,536 | B1 | * | 9/2002 | Hinshaw | 606/235 |
| 6,524,272 | B1 | | 2/2003 | Berry, Sr. | |

FOREIGN PATENT DOCUMENTS

| | | |
|---|---|---|
| GB | 0146760 | 7/1920 |
| GB | 0788905 | 1/1958 |

* cited by examiner

*Primary Examiner* — Nicholas D Lucchesi
*Assistant Examiner* — Victoria P Campbell
(74) *Attorney, Agent, or Firm* — Knoble Yoshida & Dunleavy, LLC

(57) ABSTRACT

A feeding apparatus that has particular utility for feeding infants, small children and adults that are at risk for choking on soft food includes a mesh enclosure that is open at a first end and closed at a second end. A mesh holder engages and holds open the first open end of the mesh enclosure and has an opening communicating with the interior of the mesh enclosure through which food may be inserted into the mesh enclosure. A closure mechanism is mounted to the mesh holder for movement between a first open position wherein the opening is uncovered and food may be inserted or removed from the mesh enclosure and a second closed position wherein the food is secured within the mesh enclosure. The closure mechanism advantageously remains engaged with the mesh holder in both the first and second positions.

28 Claims, 5 Drawing Sheets

MESH-TYPE FEEDER

BACKGROUND OF THE INVENTION

1. Field of the Invention

This invention relates broadly to the field of providing nourishment and sustenance to the very young and/or the disabled. More specifically, this invention relates to a mesh type feeder that may be used to feed infants, small children or adults who might otherwise be susceptible to choking while being fed.

2. Description of the Related Technology

U.S. Pat. Nos. 5,364,348 and 6,524,272 describe mesh type feeders that are used in the feeding of infants and small children to facilitate the transition between bottle feeding and spoon feeding. These feeders included a mesh enclosure that is held open by a holder and a handle member/plug that is threaded so as to be screwed into and seal an opening that is defined in the holder. The apparatus was described in that patent and later U.S. patent as having particular utility in the administration of certain foods, such as semi solid foods.

In the devices described above the handle member necessarily had to be completely disengaged and removed from the member that holds the mesh enclosure in order to insert or remove food from the interior of the mesh enclosure. This could possibly result in the handle being misplaced or contaminated with bacteria if the caregiver finds it necessary to temporarily place the handle in an unhygienic location while preparing the food and placing into the mesh enclosure. Bacteria could also be transmitted to the mesh enclosure from the caregiver's hand during screwing and unscrewing of the handle member/plug. Caregivers tend to be quite busy, especially if responsible for more than one child and are frequently trying to do several things at once. The process of screwing and unscrewing the handle member/plug from the holder necessarily required the caregiver to use both hands and required a range of wrist motion that could be painful for older caregivers or caregivers with arthritis. This is exacerbated by the fact that many caregivers might prefer to use the feeder to feed the child small amounts of food at a time, which would necessitate frequent screwing and unscrewing of the handle member/plug.

A need exists for an improved mesh type feeder that is more convenient to use and more sanitary than the conventional mesh feeders described above.

SUMMARY OF THE INVENTION

Accordingly, it is an object of the invention to provide an improved mesh type feeder that is more convenient to use and more sanitary than the conventional mesh feeders described above.

In order to achieve the above and other objects of the invention, a feeding apparatus according to a first aspect of the invention includes a mesh enclosure having a first open end and a second closed end; a mesh holder for holding the first, open end of the mesh enclosure in an open position, the mesh holder having an opening defined therein through which food may be inserted into the mesh enclosure; a closure for selectively sealing said opening; and mounting structure for mounting the closure to the mesh holder for movement between a first open position wherein food may be inserted or removed from the mesh enclosure through the opening and a second, closed position wherein the opening is sealed, the mounting structure being constructed so as to maintain engagement between the closure and the mesh holder in both the first open position and the second closed position.

According to a second aspect of the invention, a feeding apparatus includes a mesh enclosure having a first open end and a second closed end; a mesh holder for holding the first, open end of the mesh enclosure in an open position, the mesh holder having an opening defined therein through which food may be inserted into the mesh enclosure; a closure for selectively sealing the opening; and a hood member, releasably mounted to one of the mesh holder and the closure, for covering the mesh enclosure when the feeding apparatus is not in use.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
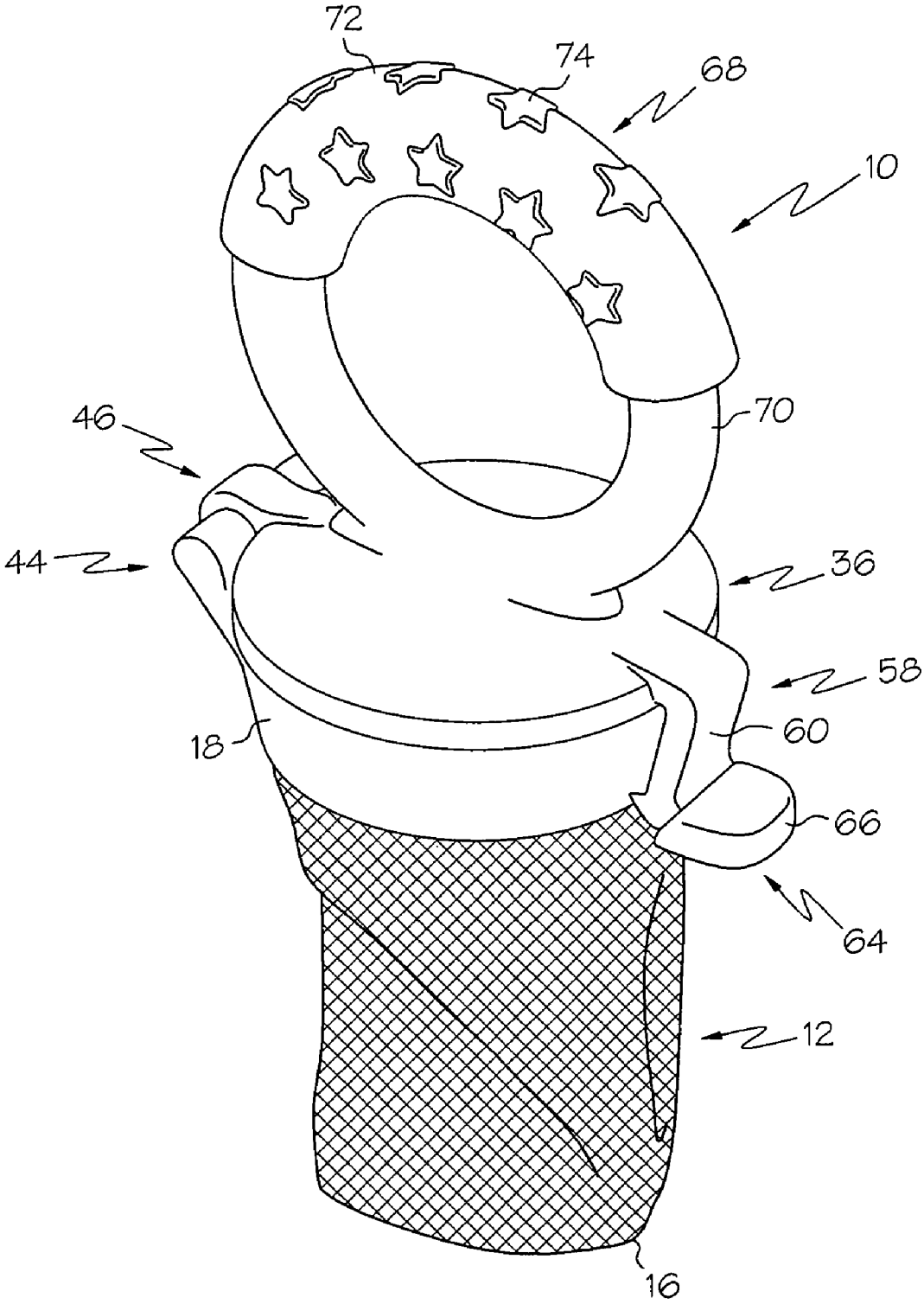
FIG. 1 is a perspective view of a feeder constructed according to a preferred embodiment of the invention, shown in a first operational position.
Figure 4:
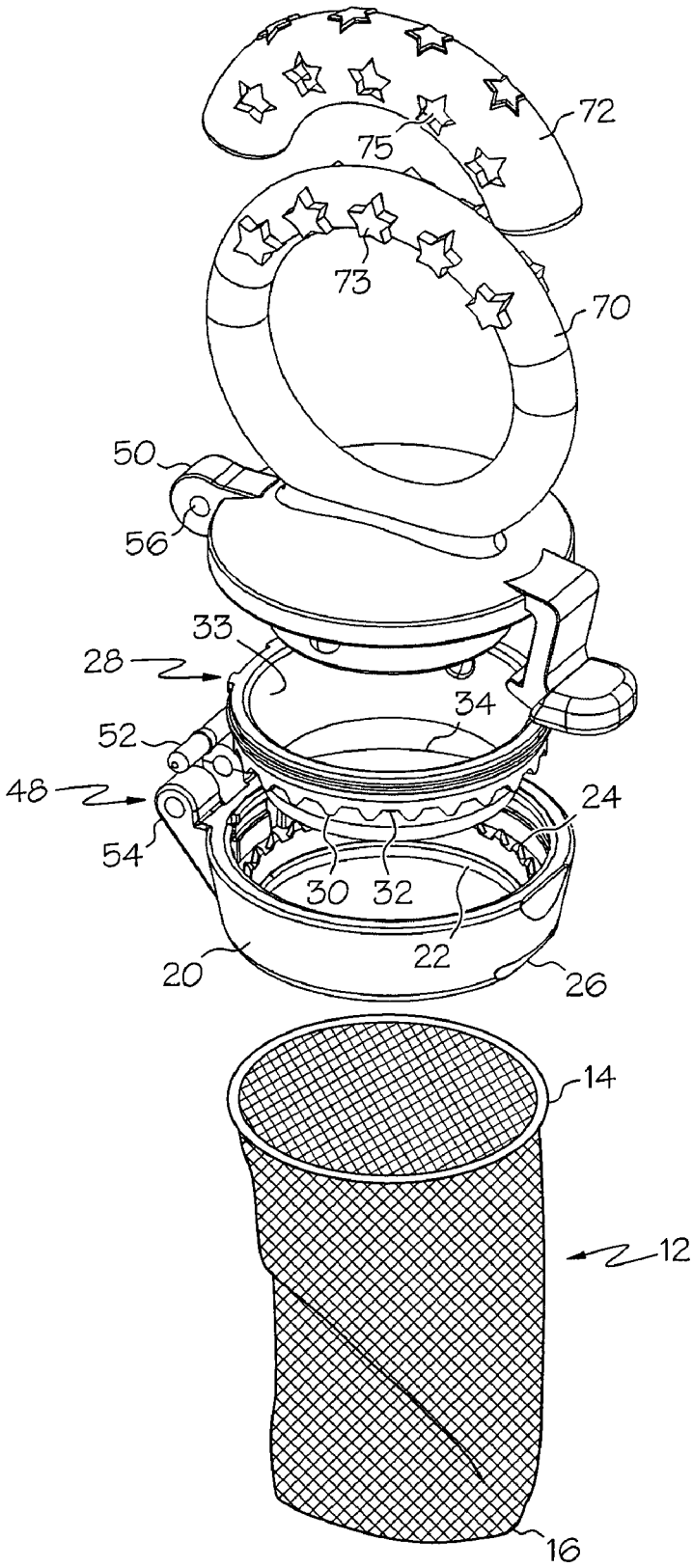
FIG. 4 is an assembly view.

Referring now to the drawings, wherein like reference numerals designate corresponding structure throughout the views, and referring in particular to FIG. 1, a feeding apparatus 10 constructed according to a preferred embodiment of the invention includes a mesh enclosure 12 having an open upper end 14, best shown in FIG. 4, and a closed lower end 16. Mesh enclosure 12 is preferably fabricated from a soft woven material that will not abrade the child's mouth, tongue and lips. In the preferred embodiment, this material is a polyester fibrous material that is woven in what will be termed a fine weave pattern. The fine weave pattern may for example be characterized as defining from about 150 holes per square inch to about 250 holes per square inch, with each hole preferably being sized to be from about 0.020 inches to about 0.10 inches in diameter.

Figure 3:
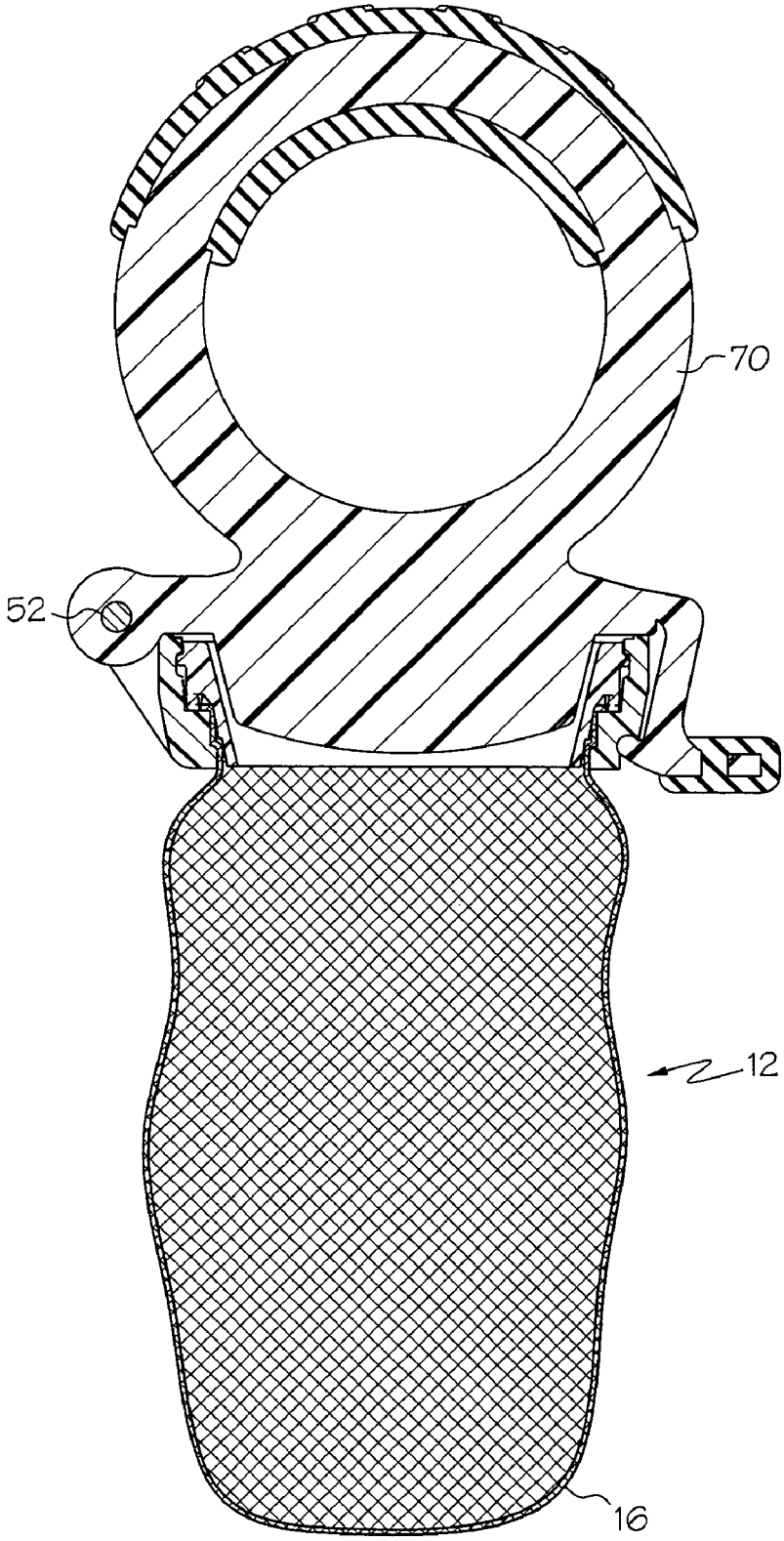
FIG. 3 is a longitudinal cross-sectional view.

Feeding apparatus 10 further preferably includes a mesh holder 18 that is preferably permanently secured to the mesh enclosure 12 proximate to the first, open end 14 so as to hold the first, open end 14 in a wide open position. Referring now to FIG. 4, it will be seen that mesh holder 18 includes a mounting ring 20 having an opening defined by an interior rim 22 through which the mesh enclosure 12 passes. Mounting ring 20 further has an interior surface from which an array of gripping teeth 24 protrude upwardly and inwardly. As may be seen in the cross-sectional view that is provided in FIG. 3, gripping teeth 24 protrude through the mesh material of the upper portion 14 of the mesh enclosure 12 to secure the mesh enclosure 12 to the mesh holder 18. A locking recess 26 is defined on an exterior surface of the mounting ring 20 for purposes that will be described in greater detail below. Mesh holder 18 further includes a mounting insert 28, best shown in FIG. 4, that is designed to snap into and be retained within mounting ring 20. Mounting insert 28 includes an exterior surface that defines a plurality of projections 30 and a corresponding plurality of sockets 32 defined therebetween. When the mounting insert 28 is snapped into the mounting ring 20 the gripping teeth 24 will interengage with the sockets 32 in order to tightly secure the mesh material of the mesh enclosure 12 between the mounting ring 20 and the mounting insert 28. The assembly of the mesh holder 18 and the mesh enclosure 12 is preferably performed in the factory and is not intended to be disassembled by the consumer.

The mounting insert 28 of the mesh holder 18 further defines a frustoconical internal surface that tapers downwardly to an inner rim 34 defining an opening through which the interior of the mesh enclosure 12 may be accessed. The entire mesh holder 18 is preferably fabricated from a resilient plastic material such as a Copolymer Polypropylene, preferably having a hardness of about 95 A Durometer.

Alternatively, the mesh holder 18 may be of one-piece construction, with the plastic material of the mesh holder either being co-molded with the mesh enclosure or molded about an upper portion of the mesh enclosure so that the mesh material is securely entrained therein.

Figure 2:
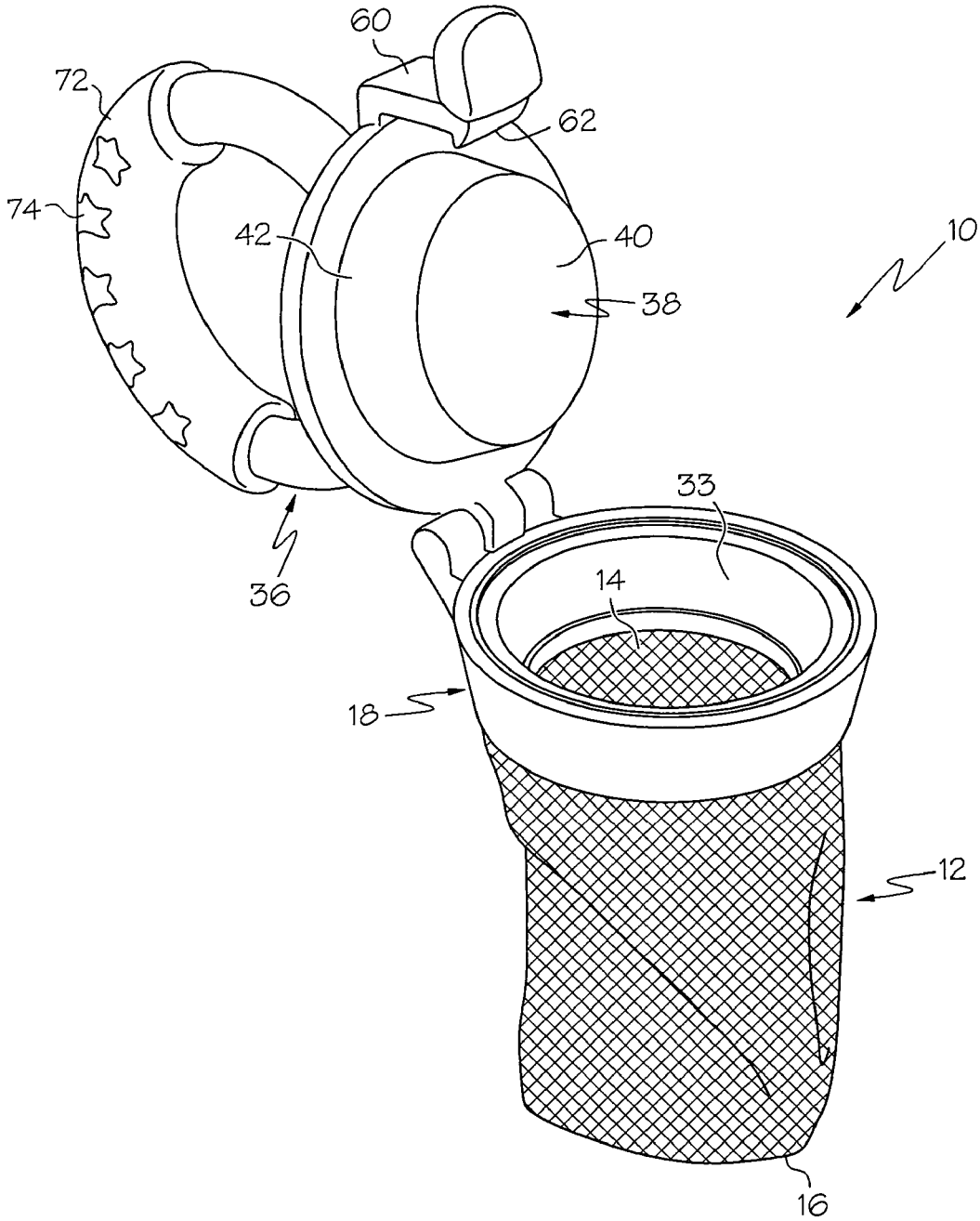
FIG. 2 is a perspective view showing the figure of FIG. 1 in a second operational position.

Referring again to FIG. 1, feeding apparatus 10 further includes a closure member 36 that is constructed and arranged to selectively cover the access opening that is defined by the rim 34 of the mounting insert 28. Closure member 36 includes a tapered plug 38 that is shaped and sized to be received by the frustoconical recess that is defined by the inner surface 33 of the mounting insert 28. Tapered plug 38 includes a flat bottom surface 40 and a frustoconical downwardly tapered side surface 42, as is best shown in FIG. 2. Closure member 36 is preferably fabricated from a resilient plastic material such as a Copolymer Polypropylene, preferably having a hardness of about 95 A Durometer.

According to one important aspect of the invention, a mounting mechanism 44 is provided to permit movement of the closure member 36 between a first open position in which food may be inserted into the mesh enclosure 12 and a second, closed position. Preferably, mounting mechanism 44 is constructed in such a manner that it remains continuously engaged with both the mesh holder 18 and the closure member 36 whether the closure member 36 is in the first position, the second position or in transit between the two positions. In the preferred embodiment of the invention, mounting mechanism 44 is embodied as a hinge 46 that constrain the closure member 36 for pivotal movement about a fixed pivot axis, as is clearly shown in the drawings, with respect to the mesh holder 18. Looking briefly to FIG. 4, it will be seen that the hinge 46 is preferably constructed as a trunnion 48 that is integral with the mounting ring 20 of the mesh holder 18 and a mating hinge projection 50 that is integral with the closure member 36. Mounting holes 54, 56 are defined in the trunnion 48 and the projection 50, respectively, and a hinge pin 52 is assembled so as to extend through and be retained within those mounting holes. Hinge pin 52 defines the pivot axis of the hinge 46 and is preferably fabricated from a low friction high strength material that will not rust, such as nylon.

According to another important aspect of the invention, a flexible latch member 58 is integral with the closure member 36 and includes a flexible arm 60 and a locking projections 62 that extends radially inwardly from a distal end of the flexible latch arm 60. Locking projection 62 is sized and shaped to be releasably received by the locking recess 26 that is defined in the exterior surface of the mounting ring 20 described above. Additionally, a gripping projection 64 extends radially outwardly from the distal end of the flexible arm 60 so that a consumer may grip the distal end of the flexible arm 60 in order to unseat the locking projection 62 from the locking recess 26. Additional structure may be provided to help the closure member 36 seat securely in relation to the mesh holder 18 when in the second, closed position. This may include a pair of raised bumps (not shown) on frustoconical surface 42 that snap into a corresponding pair of recesses that are defined in inner surface 33 of the mounting insert 28.

For safety purposes and to enhance the grippability of the gripping projection 64, a soft elastomeric overmolding 66 is provided on the protruding portion of the gripping projection 64. In the preferred embodiment, overmolding 66 is fabricated from a Thermoplastic Elastomer (TPE) having a hardness of about Durometer 60 A or softer, such as which is commercially available from GLS Corporation as grade Dynaflex 7960.

Closure member 36 further includes a handle 68 for gripping and carrying the feeding apparatus 10. In the preferred embodiment, handle 68 is constructed as a teething ring 70 and has a soft, elastomeric overmolding 72 at an upper end thereof to provide a soft teething surface for an infant or small child. Closure member 36 and handle 68 are preferably fabricate from a resilient plastic material such as a copolymer polypropylene. As is shown in FIG. 4, the underlying hard plastic portion of the teething ring 70 includes a plurality of projections 73, which in the preferred embodiment are star shaped, that extend through holes 75 that are defined in the soft elastomeric overmolding. This provides the infant or small child with a variable surface upon which to bite that is anticipated to be especially satisfying while teething. In the preferred embodiment, overmolding 72 is fabricated from a Thermoplastic Elastomer (TPE) having a hardness of about Durometer 60 A or softer, such as which is commercially available from GLS Corporation as grade Dynaflex 7960.

Figure 5:
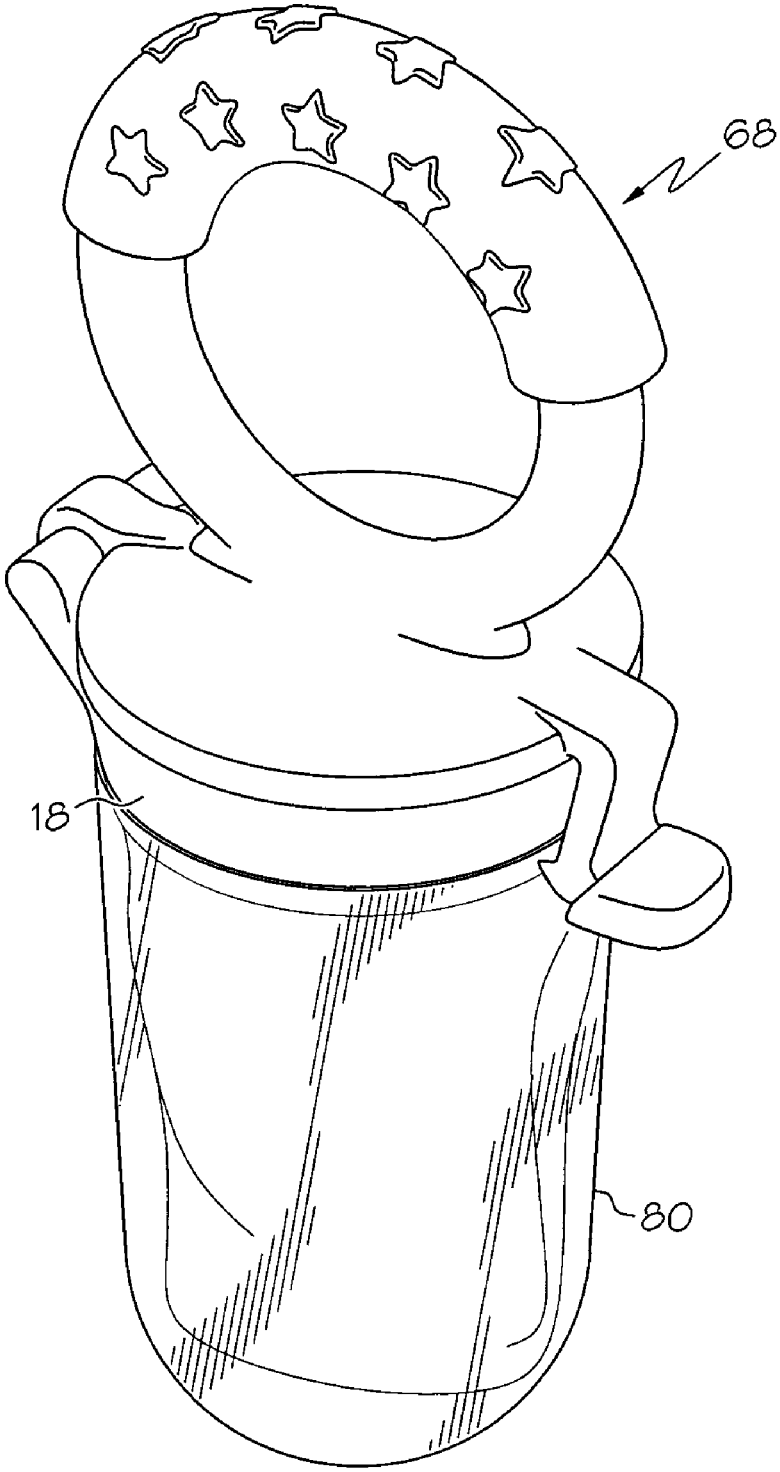
FIG. 5 is a perspective view of a feeder that is constructed according to a second embodiment of the invention.

A feeder that is constructed according to a second preferred embodiment of the invention is depicted in FIG. 5. This embodiment of the invention is identical to that described above, with the exception that a clear hard plastic hood 80 is provided that may releasably be mounted to the mesh holder 18 when the feeder is not in use. It is anticipated that the feeder according to the invention will have particular utility in feeding soft fruit to infants and small children. The provision of the plastic hood 80 will permit a caregiver to more effectively contain the juice that is given off by the soft fruit when the feeder is placed into a carrying bag or purse.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A feeding apparatus, comprising:

a mesh enclosure having a first open end and a second closed end;

a mesh holder for holding said first, open end of said mesh enclosure in an open position, said mesh holder having an opening defined therein through which food may be inserted into said mesh enclosure;

a closure member for selectively sealing said opening; and pivotal mounting means for mounting said closure member to said mesh holder for movement between a first open position wherein food may be inserted or removed from said mesh enclosure through said opening and a second, closed position wherein said opening is sealed, said pivotal mounting means being constructed so as to maintain engagement between said closure member and said mesh holder in both said first open position and said second closed position, said pivotal mounting means comprising a hinge that constrains said closure member for pivotal movement about a fixed pivot axis relative to said mesh holding means, said hinge comprising a hinge pin that defines said pivot axis.

2. A feeding apparatus according to claim 1, further comprising securement means for releasably securing said closure member in said second closed position relative to said mesh holder.

3. A feeding apparatus according to claim 2, wherein said securement means comprises a latch member positioned on one of said mesh holder and said closure member for releasably engaging structure on the other of the mesh holder and said closure member.

4. A feeding apparatus according to claim 3, wherein said latch member is positioned on said closure member.

5. A feeding apparatus according to claim 4, wherein said latch member is fabricated from a resilient material.

6. A feeding apparatus according to claim 4, wherein said latch member is integral with said closure member.

7. A feeding apparatus according to claim 4, wherein said latch member includes a radially inward extending locking projection.

8. A feeding apparatus according to claim 7, wherein said mesh holder comprises a locking recess for receiving said locking projection when said feeding apparatus is in the second, closed position.

9. A feeding apparatus according to claim 3, wherein said latch member is fabricated from a resilient material and further comprising a grip enhancing surface on said latch member for facilitating disengagement of said latch member by a consumer.

10. A feeding apparatus according to claim 9, wherein said grip enhancing surface comprises a gripping projection.

11. A feeding apparatus according to claim 10, wherein said gripping projection extends radially outwardly.

12. A feeding apparatus according to claim 10, further comprising a soft elastomeric material covering said gripping projection for safety purposes.

13. A feeding apparatus according to claim 1, further comprising a handle that is integral with said closure member.

14. A feeding apparatus according to claim 13, wherein said handle comprises a soft elastomeric overmolding covering at least a portion of said handle.

15. A feeding apparatus according to claim 13, wherein said handle has teething structure mounted thereon.

16. A feeding apparatus according to claim 15, wherein said teething structure comprises a soft elastomeric overmolding covering at least a portion of said handle.

17. A feeding apparatus according to claim 15, wherein said handle is shaped as a teething ring.

18. A feeding apparatus according to claim 1, further comprising teething structure for permitting a small child to teethe.

19. A feeding apparatus according to claim 18, wherein said teething structure comprises a soft elastomeric overmolding covering a plastic that is harder than said overmolding.

20. A feeding apparatus according to claim 1, further comprising a hood member, releasably mounted to one of said mesh holder and said closure member, for covering said mesh enclosure when said feeding apparatus is not in use.

21. A feeding apparatus according to claim 1, wherein said hinge comprises a first member that is integral with said mesh holder and a second member that is integral with said closure member, said hinge being operable so that said first and second members pivot with respect to each other.

22. A feeding apparatus according to claim 21, wherein said first member comprises a trunnion that is integral with said mesh holder.

23. A feeding apparatus according to claim 21, wherein said second member comprises a projection that is integral with said closure member.

24. A feeding apparatus according to claim 21, wherein first and second mounting holes are defined in said first and second members, respectively, and wherein said hinge pin extends through said mounting holes.

25. A feeding apparatus, comprising:

a mesh enclosure having a first open end and a second closed end;

a mesh holder for holding said first, open end of said mesh enclosure in an open position, said mesh holder having an opening defined therein through which food may be inserted into said mesh enclosure;

a closure member for selectively sealing said opening; and pivotal mounting means for mounting said closure member to said mesh holder for movement between a first open position wherein food may be inserted or removed from said mesh enclosure through said opening and a second, closed position wherein said opening is sealed, said pivotal mounting means being constructed so as to maintain engagement between said closure member and said mesh holder in both said first open position and said second closed position, said pivotal mounting means comprising a hinge that constrains said closure member for pivotal movement about a fixed pivot axis relative to said mesh holding means, wherein said hinge comprises a first member that is integral with said mesh holder and a second member that is integral with said closure member, said hinge being operable so that said first and second members pivot with respect to each other.

26. A feeding apparatus according to claim 25, wherein said first member comprises a trunnion that is integral with said mesh holder.

27. A feeding apparatus according to claim 25, wherein said second member comprises a projection that is integral with said closure member.

28. A feeding apparatus according to claim 25, wherein first and second mounting holes are defined in said first and second members, respectively, and wherein said hinge pin extends through said mounting holes.

* * * * *